US007740140B2

(12) United States Patent
Schmidt et al.

(10) Patent No.: US 7,740,140 B2
(45) Date of Patent: Jun. 22, 2010

(54) METHOD AND APPARATUS FOR SORTING TABLETS AT A ROTARY PRESS FOR MAKING TABLETS

(75) Inventors: Ingo Schmidt, Schwarzenbek (DE); Andreas Arning, Talkau (DE); Kai Hübner, Ratzeburg (DE)

(73) Assignee: Fette GmbH, Schwarzenbek (DE)

( * ) Notice: Subject to any disclaimer, the term of this patent is extended or adjusted under 35 U.S.C. 154(b) by 426 days.

(21) Appl. No.: 11/347,816

(22) Filed: Feb. 3, 2006

(65) Prior Publication Data

US 2006/0171577 A1 Aug. 3, 2006

(30) Foreign Application Priority Data

Feb. 3, 2005 (DE) ..... 10 2005 005 012

(51) Int. Cl.
*B07C 5/00* (2006.01)

(52) U.S. Cl. ..... 209/552; 209/639; 209/644; 209/44.2

(58) Field of Classification Search ..... 209/552, 209/639, 644, 44.2
See application file for complete search history.

(56) References Cited

U.S. PATENT DOCUMENTS 5,145,693 A 9/1992 Hinzpeter et al. ..... 425/149
5,322,655 A * 6/1994 Ebey ..... 264/40.5
6,630,633 B1 * 10/2003 Uber et al. ..... 177/145
6,918,493 B2 * 7/2005 Hinzpeter et al. ..... 209/644
2005/0173313 A1 * 8/2005 Tyvoll et al. ..... 209/644

FOREIGN PATENT DOCUMENTS

| | | |
|---|---|---|
| DE | 24 50 065 | 5/1977 |
| DE | 36 39 918 | 10/1977 |
| EP | 1 247 640 B1 | 2/2002 |
| GB | 705000 | 3/1954 |

* cited by examiner

*Primary Examiner*—Patrick Mackey
*Assistant Examiner*—Kalyanavenkateshware Kumar
(74) *Attorney, Agent, or Firm*—Vidas, Arrett & Steinkraus, P.A.

(57) ABSTRACT

A method for sorting tablets at a rotary press for making tablets, comprising the following steps: the individual tablets are monitored with regard to at least one property of their condition during the pressing process, and a bad-signal is generated, if a tablet does not fulfill the property, and tablets which do not generate a bad-signal being good-tablets; the good-tablets are directed from a die plate of the rotary press into a good-channel; after a bad-signal has been generated, a bad-tablet is directed into a bad-channel by means of an air blast; by means of a further air stream, which is directed into the bad-channel, the bad-tablet is accelerated into the bad-channel whereby a returning to the die plate is avoided.

12 Claims, 1 Drawing Sheet

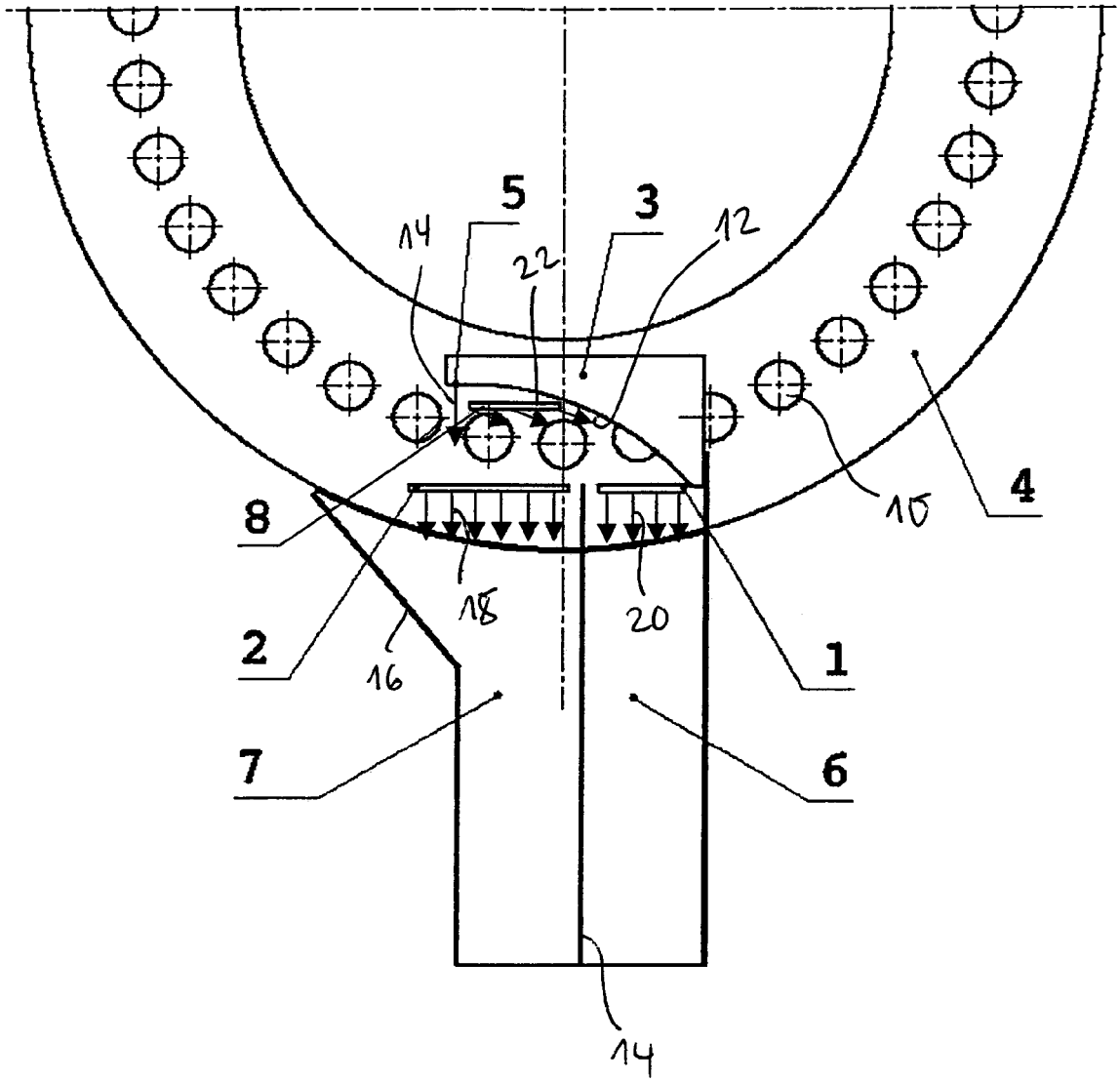
5
3
14
22
12
4
15
8
18
20
2
16
1
7
6
14

METHOD AND APPARATUS FOR SORTING TABLETS AT A ROTARY PRESS FOR MAKING TABLETS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

A rotary press for making tablets of the mentioned type has become known from GB 705 000A1. From U.S. Pat. No. 5,145,693 it has also become known to measure the compression force exerted on the tablets during the production in the machine, and to single out the bad-tablets, which do not fulfill the desired requirements. It is to be understood that other parameters can be monitored as well in order to separate good tablets from bad tablets.

From EP 1 247 640 it has also become known to sort out bad-tablets by means of a nozzle. A control unit gets a bad-signal from the monitoring device and opens the nozzle, which is connected to a source of compressed air, for a short period of time, so that a bad-tablet can be directed into a bad-channel. Such an air blast is generated only within a few milliseconds, and it is naturally required to generate this air blast at a point in time in which the bad-tablet is disposed in front of the entry of the bad-channel. Moreover, the ejection of bad-tablets by means of an air blast has become known from DE 36 399 18 A1.

After the pressing process, the tablets are ejected towards the upper side of the die plate by means of the lower punches, so that a stationary wiper, in form of a wiper sheet, can pick up the tablets and direct them into a good-channel. It is to be understood, that the bad-tablets have to be sorted out before they reach the good-channel.

It is a prerequisite for a safe sorting-out of the bad-tablet, that the tablet is disposed in a stable position in front of the nozzle, because—as mentioned before—the blasting process occurs only within a few milliseconds. As a result of different characteristics of the material of the tablets and of different shapes of the tablets, tablets may queue up in the region of the tablet wiper or in the good-channel, so that the position of the tablets in front of the ejection nozzle may be altered. Thereby, a safe sorting-out process is not achieved. A congestion of tablets may even cause damage of parts of the tablet press.

It may further happen that bad-tablets blown into the bad-channel hit the wall of the bad-channel and get reflected, thereby getting into the good-channel or at least impeding the successive tablets in being conveyed. The trajectories of the blown and reflected tablets are determined to the largest extent by the air pressure, the shape, weight and thickness of the tablets.

The invention is based on the object to provide a method for sorting out bad-tablets in a rotary press for making tablets, which allows for higher reliability in sorting out the bad-tablets, without negatively affecting the conveying of the good-tablets into the good-channel.

BRIEF SUMMARY OF THE INVENTION

According to the method of the invention, a tablet that has been sorted out is accelerated by means of an air stream directed into the bad-channel, and a returning of the tablet to the die plate is avoided.

The mentioned air stream, which can be provided permanently during operation of the rotary press, further accelerates the tablets that have been sorted out and moved into the bad-channel by the air blast, and prevents that the tablets queue up or congest in the bad-channel. In addition, tablets that have been sorted out and are bouncing back are prevented from getting into the sorting out area or production area. Altogether, disturbances in the sorting area are avoided. As is generally known, such rotary presses for making tablets produce large quantities of tablets per time unit. A down time of the machine, even for a short period of time only, and the related discontinuity of production causes significant economical disadvantages.

According to an embodiment of the invention, every good-tablet is directed from the die plate into a good-channel by means of a wiper. In an embodiment of the invention, a second air stream is generated, which accelerates the good-tablets into the good-channel. This air stream has primarily the function to prevent a congestion in the good-channel. A congestion in the good-channel would quickly propagate into the region of the wiper, thereby causing a discontinuity of production.

A further embodiment of the invention provides a third air stream in front of a section of the wiper which directs the tablets towards the wiper and the good-channel. This measure prevents the good-tablets from queuing up at the wiper. The tablets are directed in the direction of the wiping surface and can get from there directly into the good-channel.

The apparatus for sorting tablets at a rotary press for making tablets according to the invention is provided with at least one first nozzle means, which generates an air stream into the bad-channel. In this respect, an embodiment of the invention is provided with a second nozzle means, which is disposed in conveying direction of the tablets behind the wiper and which generates an air stream directed into the good-channel. In this respect, a further embodiment of the invention is provided with a third nozzle means, which is disposed in conveying direction of the tablets in front of a redirection section of the wiper and which generates an air stream directed towards the redirection section or the good-channel, respectively.

The nozzle means can be implemented in a suitable manner. One could think of several adjacent nozzle openings, which generate a sort of air veil. Preferably, the supply pipes leading to the nozzle means are provided with means for controlling the air pressure for the nozzle openings individually. Based on the production conditions and the type of tablets, the air pressures can be adjusted differently in order to achieve the desired sorting behavior. The values for the air pressures can be stored in a control computer, to be read out from time to time, when a check up is performed. Furthermore, the air pressure values can be stored in the control computer dependent on the specific types of tablets and can be transferred to a control computer of the rotary press for making tablets, if required. The control computer sets the respective pressure value and monitors this value.

In the following, an embodiment of the invention shall be explained in greater detail together with a drawing.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated FIG. 1 is a top view on a part of a rotary press for making tablets with a sorting apparatus according to the invention.

In the drawing, a die plate 4 of a rotor of a rotary press can be seen from the top, with die bores 10 disposed in a circle. As is known as such, portions of powder filled into the die bores are pressed to a tablet by means of upper punches and lower punches (not shown). By means of the lower punches, the finished compacts are pressed out of the die bores 10, so that they can be directed into the good-channel 6 by means of a wiper 3, which exhibits an approximately circularly arcuated deflection surface 12.

In front of the good-channel 6 and approximately in parallel thereto, a bad-channel 7 is provided, wherein both channels 6, 7 are adjoining and are separated by a single wall 14 from each other. At 5, there is indicated a nozzle, which generates an air stream in the direction of the arrow 14 in towards the output channel 7. The entry section of a bad-channel 7 is widened, as is indicated by the tapered part 16. The air stream is generated, when a bad-tablet has been detected by a monitoring device not shown and the control unit (not shown) for the nozzle 5 "knows", when the bad-tablet has reached the region of the nozzle 5. The air blast is generated only for a few milliseconds. At the same time, the strongly accelerated tablet can hit the inclined wall of the entry region 16 of the bad-channel 7 and bounce back in the direction of the deflection surface 12 of the wiper 3 and even get into the good-channel 6. This may happen, although the wall 14 extends into the area above the die plate 4.

At 2, a nozzle is indicated which is disposed above the die plate 4 and extends over the largest fraction of the width of the bad-channel 7. The nozzle 2 is provided with a row of nozzle openings as indicated by the arrows 18. With the help of the single openings, an air stream can be generated which is directed into the bad-channel 7. The air stream 18 is generated permanently during the operation of the rotary press. If a bad-tablet is moved in the direction of the bad-channel by the nozzle 5, the air stream 18 supports the acceleration of the bad-tablet, so that it can propagate through channel 7 without forming a queue. Also, a bouncing back of the bad-tablet is avoided in this manner.

On top of and in front of the entry of the good-channel 6, a nozzle 1 is provided, which exhibits a row of nozzle openings in the same way as nozzle 2 does, and which is suited to generate an air stream 20 into the good-channel 6. The air stream 20 makes sure that good-tablets—as soon as they have passed the nozzle 1—are moved into the good-channel 6 in an accelerated fashion, thereby preventing congestions in the good-channel.

A third nozzle 8 is provided in conveying direction or rotary direction of the die plate 4, between the nozzle 5 and the wiping section or redirection section of the redirection surface 12 of the wiper 3, said wiping section or redirection section performing the actual deflection into the good-channel for the tablets. The nozzle openings are—as indicated by the arrows 22—obliquely oriented with reference to the longitudinal extension of the nozzle 8, whereby an air stream in the direction of the good-channel 6 or the redirection section of the wiper 3 is generated. This air stream 22 supports the flow of the tablets, which is generated by ejection from the die bores 10 and prevents a congestion of the tablets in the region of the wiper 3.

The air pressure for every nozzle 2, 8 and 1 is individually adjustable by an air valve or the like, and the pressure which has been set can be read off from a suitable display separately. In addition or in the alternative, the control unit of the machine can store the respective air pressure conditions for every product to be compacted and read them out, adjust and regulate them, if required.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims. Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method for sorting tablets at a rotary press for making tablets, comprising the following steps:

the individual tablets are monitored with regard to at least one property of their condition during the pressing process, and a bad-signal is generated, if a tablet does not fulfill the property, and tablets which do not generate a bad-signal being good-tablets;

the good-tablets are directed from a die plate of the rotary press into a good-channel;

after a bad-signal has been generated, a bad-tablet is directed into a bad-channel by means of an air blast;

by means of a further air stream, which is continuous, and starts in the entrance of the bad channel and which directs the bad-tablet into the bad-channel, the bad-tablet is accelerated into the bad-channel whereby a returning to the die plate is avoided, and directing the good-tablets from the die plate into a good-channel by means of a wiper, and in that a second air stream is directed into the good-channel, which accelerates the good-tablets into the good-channel.

2. A method according to claim 1, characterized in that the good-tablets are directed from the die plate into the good-channel by means of a wiper, and in that in front of a wiping section of the wiper, a third air stream is generated, which directs the tablets in the direction of the wiper and the good-channel.

3. An apparatus for sorting tablets at a rotary press for making tablets, comprising:

a wiper is provided associated with a die plate of a rotor of said rotary press, said wiper directing the tablets ejected from die bores of the die plate from the upper side of the die plate into a good-channel, and wherein, in the rotary direction of the rotor, a bad-channel is provided in front of the good-channel, said bad-channel being provided with an associated nozzle, the air blast of said nozzle being directed into the bad-channel, and wherein further a monitoring device at the rotary press monitors at least one property of the tablet and generates a bad-signal, if the desired property of a tablet is not fulfilled, and a control unit for the nozzle activates the nozzle in accordance with the bad-signal, characterized in that a first nozzle (2), located at the entrance of the bad channel, and is provided in the direction of the air stream in front of the nozzle (5), generating an air stream directed into the bad-channel (7), and further wherein the good-tab1ets from the die plate are directed into a good-channel by the wiper, and in that a second air stream is directed into the good-channe1, which accelerates the good-tablets into the good-channel.

4. An apparatus according to claim 3, characterized in that a second nozzle (1) is provided in conveying direction behind the wiper (3), generating the second air stream directed into the good-channel.

5. An apparatus according to claim 4, characterized in that a third nozzle (8) is provided in conveying direction of the tablets in front of a deflecting section of the wiper (3), generating an air stream directed towards the deflecting section or the good-channel, respectively.

6. An apparatus according to claim 5, characterized in that the first, second and/or third nozzles (2, 1, 8) exhibit a row of adjacent nozzle apertures.

7. An apparatus according to claim 5, characterized in that the air pressure in the supply pipes for the first, second and/or third nozzles (2, 1, 8) is individually adjustable.

8. An apparatus according to claim 3, characterized in that the air pressure corresponding to the nozzle is displayed separately.

9. An apparatus according to claim 5, characterized in that the rotary press exhibits a control computer and in that the air pressure values associated with the first, second and/or third nozzles (2, 1, 8) are stored in a memory of the control computer.

10. An apparatus according to claim 9, characterized in that air pressure values, associated with predetermined types of tablets, are stored in the memory and can be read out for use in the control computer, which is used to set and monitor the air pressures.

11. An apparatus according to claim 3, characterized in that the bad-channel (7) adjoins the good-channel (6) and in that both are running in parallel at least at their beginnings.

12. An apparatus according to claim 3, characterized in that a dividing wall (14) is provided between the good-channel (6) and the bad-channel (7), extending into the area above the die plate (4).

* * * * *